US007694514B2

(12) United States Patent
Smith et al.

(10) Patent No.: US 7,694,514 B2
(45) Date of Patent: Apr. 13, 2010

(54) DIRECT CONTACT THERMAL EXCHANGE HEAT ENGINE OR HEAT PUMP

(75) Inventors: Lee S. Smith, Boulder, CO (US); Samuel P. Weaver, Boulder, CO (US); Brian P. Nuel, Nederland, CO (US); William H. Vermeer, Longmont, CO (US)

(73) Assignee: Cool Energy, Inc., Boulder, CO (US)

( * ) Notice: Subject to any disclaimer, the term of this patent is extended or adjusted under 35 U.S.C. 154(b) by 80 days.

(21) Appl. No.: 11/944,147

(22) Filed: Nov. 21, 2007

(65) Prior Publication Data

US 2009/0038307 A1 Feb. 12, 2009

Related U.S. Application Data

(60) Provisional application No. 60/954,641, filed on Aug. 8, 2007.

(51) Int. Cl.
*F01B 29/10* (2006.01)
*F02G 1/04* (2006.01)
*F25B 9/00* (2006.01)

(52) U.S. Cl. ..... 60/517; 60/521; 62/6

(58) Field of Classification Search ..... 60/517–526
See application file for complete search history.

(56) References Cited

U.S. PATENT DOCUMENTS 3,006,146 A 10/1961 Jackson
3,457,722 A * 7/1969 Bush ..... 60/522
3,533,232 A 10/1970 Hodgson
3,608,311 A 9/1971 Roesel, Jr.
3,638,420 A 2/1972 Kelly et al.
3,772,883 A 11/1973 Davoud et al.
3,879,945 A 4/1975 Summers
3,996,745 A 12/1976 Davoud et al.
3,998,056 A 12/1976 Clark
4,055,962 A 11/1977 Terry
4,148,195 A 4/1979 Gerstmann et al.
4,149,389 A 4/1979 Hayes et al.

(Continued)

FOREIGN PATENT DOCUMENTS

DE 3815606 A1 12/1988

(Continued)

OTHER PUBLICATIONS

Senfit, James R., "An Introduction to Stirling Engines," Moriya Press, 1993, pp. 40-43.

(Continued)

*Primary Examiner*—Thomas E Denion
*Assistant Examiner*—Christopher Jetton
(74) *Attorney, Agent, or Firm*—Townsend and Townsend and Crew LLP

(57) ABSTRACT

Systems and methods for operating a thermodynamic engine are disclosed. The systems and methods may effect cyclic motion of a working fluid between hot and cold regions of a thermodynamic engine and inject a dispersible material into the working fluid at the hot or cold region during a heat-addition or heat-rejection process. The system and methods may also evacuate the dispersible material from the hot or cold region.

39 Claims, 3 Drawing Sheets

U.S. PATENT DOCUMENTS

| | | | | | |
|---|---|---|---|---|---|
| 4,313,304 | A | | 2/1982 | Hunt | |
| 4,339,930 | A | | 7/1982 | Kirts | |
| 4,367,625 | A | | 1/1983 | Vitale | |
| 4,412,418 | A | * | 11/1983 | Beale | 60/520 |
| 4,433,550 | A | | 2/1984 | Durenec | |
| 4,522,033 | A | | 6/1985 | Jensen | |
| 4,532,778 | A | | 8/1985 | Clark et al. | |
| 4,586,334 | A | | 5/1986 | Nilsson, Sr. et al. | |
| 4,753,072 | A | | 6/1988 | Johansson et al. | |
| 4,894,989 | A | | 1/1990 | Mizuno et al. | |
| 4,897,997 | A | | 2/1990 | Meijer et al. | |
| 4,981,014 | A | | 1/1991 | Gallagher | |
| 5,010,734 | A | | 4/1991 | Ho | |
| 5,115,157 | A | | 5/1992 | Blumenau | |
| 5,180,035 | A | * | 1/1993 | Gaudlitz | 184/6.15 |
| 5,195,321 | A | | 3/1993 | Howard | |
| 5,228,293 | A | | 7/1993 | Vitale | |
| 5,343,632 | A | * | 9/1994 | Dinh | 34/507 |
| 5,428,653 | A | | 6/1995 | El-Genk | |
| 5,438,846 | A | | 8/1995 | Datta | |
| 5,638,684 | A | * | 6/1997 | Siegel et al. | 62/6 |
| 5,706,659 | A | | 1/1998 | Houtman | |
| 5,782,084 | A | | 7/1998 | Jarvis | |
| 5,875,863 | A | | 3/1999 | Jarvis et al. | |
| 5,899,071 | A | | 5/1999 | Stone et al. | |
| 5,916,140 | A | | 6/1999 | Hageman | |
| 5,918,463 | A | | 7/1999 | Penswick et al. | |
| 5,934,076 | A | | 8/1999 | Coney | |
| 6,286,310 | B1 | | 9/2001 | Conrad | |
| 6,305,442 | B1 | | 10/2001 | Ovshinsky et al. | |
| 6,330,800 | B1 | | 12/2001 | Price et al. | |
| 6,470,679 | B1 | | 10/2002 | Ertle | |
| 6,536,207 | B1 | | 3/2003 | Kamen et al. | |
| 6,606,860 | B2 | | 8/2003 | McFarland | |
| 6,625,992 | B2 | | 9/2003 | Maguire et al. | |
| 6,701,721 | B1 | | 3/2004 | Berchowitz | |
| 6,843,057 | B2 | | 1/2005 | Yamamoto | |
| 6,948,315 | B2 | | 9/2005 | Kirby et al. | |
| 6,996,988 | B1 | | 2/2006 | Bussard | |
| 7,617,680 | B1 | | 11/2009 | Weaver et al. | |
| 2003/0074897 | A1 | | 4/2003 | Rollston | |
| 2004/0118449 | A1 | | 6/2004 | Murphy et al. | |
| 2005/0172623 | A1 | | 8/2005 | Hurt | |
| 2005/0279094 | A1 | | 12/2005 | Yoshino | |

FOREIGN PATENT DOCUMENTS

| | | | |
|---|---|---|---|
| DE | 3834703 | A1 | 4/1990 |
| DE | 19843600 | A1 | 3/1999 |
| JP | 4093559 | A | 3/1992 |
| WO | WO 94/12785 | A | 6/1994 |

OTHER PUBLICATIONS

"Low-Cost Solar-Thermal-Electric Power Generation," author unknown, found online on Jul. 18, 2008 at http://www.cs.berkeley.edu/~artin/Research/research.html, 6 pages.

Der Menassians, Artur, "Stirling Engines for Low-Temperature Solar-Thermal-Electric Power Generation," Written Disseration from the University of CA Berkeley, 2007, 205 pages.

Der Menassians, Artur, "Stirling Engines for Low-Temperature Solar-Thermal-Electric Power Generation," Dissertation Talk, Nov. 19, 2007, 34 pages.

Fette, Peter, "Stirling Engine Research and Computer Programm Development for the simulation of the heat-process and the dynamic of a-type stirling engines", printed Dec. 10, 2009 online at: http://home.germany.net/101-276996/fette.htm, last updated Oct. 1, 2008, 3 pages.

Fette, Peter, Animation of Alpha-type Stirling Motors, printed Dec. 10, 2009 online at: http://home.germany.net/101-276996/animation.htm, last updated Oct. 1, 2008, 2 pages.

* cited by examiner

DIRECT CONTACT THERMAL EXCHANGE HEAT ENGINE OR HEAT PUMP

CROSS REFERENCE TO RELATED APPLICATION

This application is a nonprovisional of, and claims the benefit of the filing date of, U.S. Prov. Pat. Appl. No. 60/954,641, entitled "DIRECT CONTACT THERMAL EXCHANGE HEAT ENGINE OR HEAT PUMP," filed Aug. 8, 2007 by Lee S. Smith and Samuel P. Weaver, the entire disclosure of which is incorporated herein by reference for all purposes.

BACKGROUND OF THE INVENTION

This application relates generally to thermodynamic engines, including heat pumps. More specifically, this application relates to a direct-contact thermal-exchange heat engine or heat pump.

Many thermodynamic cycles that transform thermal energy into work or vice versa are inherently limited to an efficiency that is less than 100% of the fundamental Carnot efficiency limit. This shortcoming arises because the addition or rejection of heat may take place at points in the thermodynamic cycle other than at the hottest and coldest temperature limits. There therefore exists a need in the art for improved methods and systems for converting between thermal and other forms of energy, and for improved methods and systems that add or reject heat at hot and cold temperature limits of a thermodynamic cycle.

BRIEF SUMMARY OF THE INVENTION

Embodiments of the invention provide thermodynamic engines and methods of operating thermodynamic engines. Such thermodynamic engines may include, for example, heat engines and heat pumps. Conversion is achieved between mechanical and thermodynamic energy by action of a working fluid on a mechanical component. Cyclic motion of the working fluid is effected between a hot region of the thermodynamic engine and a cold region of the thermodynamic engine. The working fluid may sometimes comprise a compressible working fluid. The hot region has a temperature greater than a temperature of the cold region. A dispersible material is injected into the working fluid in at least one of the working spaces of a hot region or a cold region to effect a heat-exchange process between the dispersible material and the working fluid without effecting substantial work on the working fluid or on the mechanical component with the dispersible material.

A hot dispersible material may be injected into the working fluid in a working space of a hot region of the thermodynamic engine and a cold dispersible material may be injected into the working fluid in a working space of a cold region of the thermodynamic engine.

The dispersible material may be evacuated from the working fluid. In a particular embodiment, the evacuated dispersible material is directed to a heat exchanger, where heat is added to or removed from the dispersible material, and is again injected into the working fluid.

The dispersible material may comprise a liquid, powder, or slurry in different embodiments, and may be injected continuously or intermittently through a single port or multiple ports, and may be evacuated continuously or intermittently.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components.

DETAILED DESCRIPTION OF THE INVENTION

The term "thermodynamic engines" as used throughout this disclosure generally includes "heat engines" and "heat pumps"; when describing physical processes of the invention, the pertinent operations of heat engines may be inverted when necessary to describe the operation of heat pumps.

The inventors have recognized that deficiencies in improving the efficiency of thermodynamic engines may be linked to the fact that in practice, heat addition and heat rejection processes in such engines are not strictly isothermal. The limits to achieving 100% Carnot efficiency with a thermodynamic cycle that has strictly isothermal heat addition and heat rejection processes, however, would be entirely practical and not thermodynamic. Embodiments of the invention therefore realize better isothermal heat addition and heat rejection processes within a heat engine or a heat pump.

Figure 1:
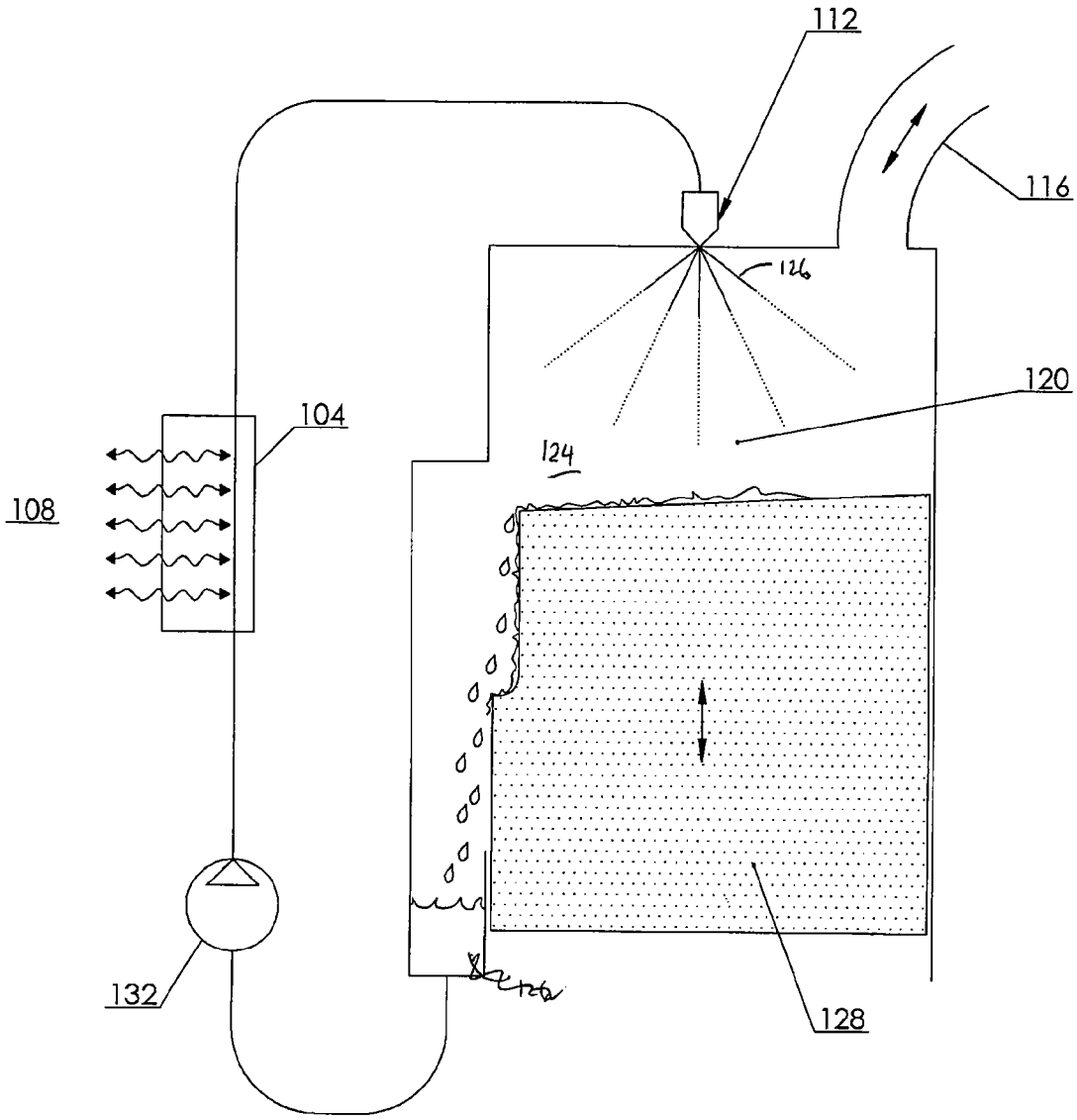
FIG. 1 provides a schematic illustration of a principle used by embodiments of the invention to inject dispersible material into a working space of a thermodynamic engine.

A basic principle used in embodiments of the invention is illustrated with FIG. 1, which provides a schematic illustration of a portion of a thermodynamic engine. The portion includes a piston 128 whose motion in a working space 124 represents mechanical energy, with the engine operating generally to effect a conversion between thermodynamic and mechanical energy. A working fluid 120 is acted on by motion of the piston and may be moved through a passageway 116 connecting the working space 124 to other portions of the engine. Isothermal heat addition and heat rejection are achieved by injecting a hot dispersible material 126 such as a liquid, slurry, or powder into the working fluid 120 during the heat-addition or heat-rejection process occurring at the hottest temperature of the cycle, and by injection a cold dispersible material into the working fluid during the heat addition or heat-rejection process occurring at the coldest temperature of the cycle. The injection causes direct-contact convective heat exchange between the dispersible material 126 and the working fluid 120. In specific embodiments, there is no substantial collection of the dispersible material in the working space, nor is work transmitted by the dispersible material between the working fluid and the representation of mechanical energy.

Injection of the dispersible material 126 may take place with an injection mechanism 112. The dispersible material 126 may issue from the injection mechanism 112 in various patterns, including conical, solid, or sheet, or in composite patterns synthesized by the combination of patterns of dispersible material issuing from combinations of injection mechanisms, so as to promote convective heat exchange while passing through the working fluid 120.

The injection of the dispersible material may occur substantially continuously, intermittently, or variably. Continuous injection is simple, reliable, and inexpensive, and does not have to be rapidly varied, if at all. But is has the potential to unnecessarily inject the dispersible material 126 at certain instances in the thermodynamic cycle when the rate of heat added or rejected by the working fluid 120 may be inherently small or zero. This can incur unnecessary energy expenditure by injecting during these instances and can burden the process that evacuates the dispersible material 126 from the working space 124. Intermittent injection, however, may be timed in some embodiments to coincide with the greatest rate of heat addition or rejection or some other cyclic process of the working fluid 120 and would therefore incur less energy expenditure and inject less dispersible material 126 that is to be evacuated from the cylinder. In any of these embodiments, the amount of injected dispersible material 126 could vary with the amount of mass of working fluid 120 contained within the working space 124, provided it is sufficient to maintain isothermal heat addition or rejection. The amount of mass of working fluid may be varied, for example, in order to vary engine power output by varying the change pressure of the working fluid 120.

The heat exchange process may be enhanced by a large surface area of the injected dispersible material and a large relative velocity between the dispersible material and the working fluid. The dispersible material may be evacuated from its working space and transmitted through a dispersible-material conveyance mechanism 132. The conveyance mechanism 132 directs the dispersible material to a heat exchanger 104 to reject or accept heat from a heat sink or source 108. The conveyance mechanism 132 then recycles the dispersible material back to the injection mechanism 112. Except for pressure drops through the heat exchanger 104 and the injection mechanism 112, the dispersible material is substantially at the same pressure as the working fluid 120 and is not conveyed against any other pressure difference.

With such embodiments, the maximum thermodynamic efficiency of the heat engine or heat pump is not inherently limited to something less than the Carnot limit.

Figure 2:
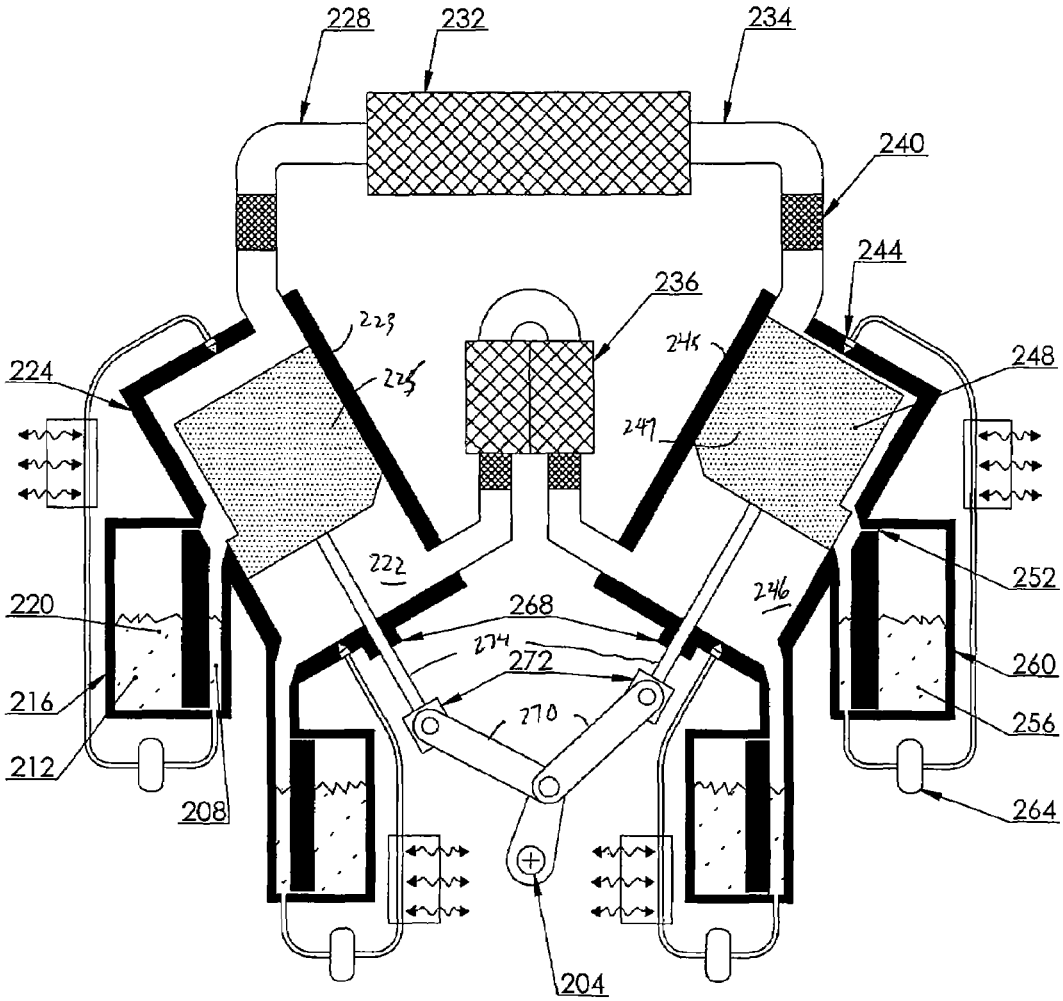
FIG. 2 provides a schematic illustration of a thermodynamic engine that makes use of the injection of dispersible material into working spaces according to embodiments of the invention.
Figure 3:
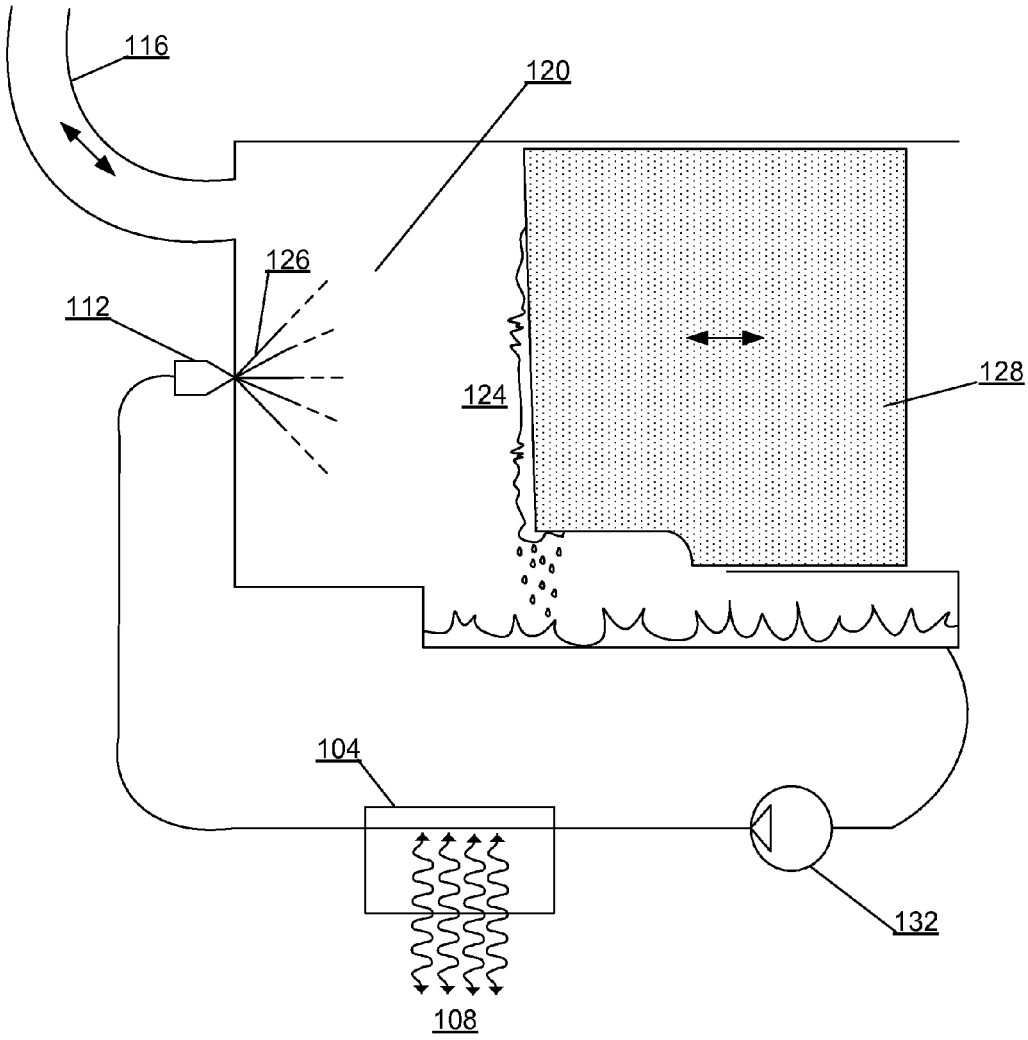
FIG. 3 provides an embodiment of the invention to inject dispersible material into a working space of a thermodynamic engine, with a horizontal cylinder configuration.

A schematic illustration of a system is illustrated in FIG. 2 for an embodiment in which the dispersible material comprises a liquid. The "hot" region or side of the system is shown generally on the left portion of the drawing and the "cold" region or side of the system is shown generally on the right portion of the drawing. The "hot temperature" process occurs in a "hot working space" 222 that comprises a "hot cylinder" 223 and a sealable movable "hot piston" 225. The "cold temperature" process similarly occurs in a "cold working space" 246 that comprises a "cold cylinder" 245 and a sealable movable "cold piston" 247.

The hot and cold working spaces 222 and 246 are connected by a passageway 228 and 234. Together with this passageway, the hot and cold working spaces 222 and 246 form a sealed variable volume sometimes referred to collectively herein as the "total volume" that contains the working fluid.

Both the hot and cold pistons are "double acting," similar to the sense in which double-acting steam or diesel engines operate. The hot-temperature process thus operates on both sides of the hot piston 225 and the cold-temperature process operates on both sides of the cold piston 247. Mechanical motion of the pistons 225 and 247 on each region of the system varies the total volume to effect the conversion between mechanical and thermodynamic energy. The pistons are operated by a crankshaft 204 and are connected to it through piston rods 270, crossheads 272, and connecting rods 274. Dynamic seals 268 are provided to prevent leakage of the working fluid past the piston rods 270. Of these moving parts, only the piston rods 270 penetrate the envelope containing the working fluid, typically confined at high pressure.

Although shown as a V-type structure, other arrangements of the cylinders 223 and 245 are possible. In particular, the cylinders may be arranged horizontally and radially in two banks, with their pistons connected to a vertical two-throw crankshaft. The lower bank may comprise cylinders containing hot working spaces, and the upper bank may comprise cylinders containing cold working spaces. A large engine so configured may advantageously power a vertical electric generator, similar to those powered by vertical water turbines at hydroelectric power plants.

In embodiments where the system operates as a heat engine, the heat-addition process may occur at or near the hot temperature and the heat-rejection process may occur at or near the cold temperature. The pistons then move such that the total volume generally increases when heat is added to the working fluid and generally decreases when heat is removed from the working fluid. Mechanical work is thus produced by the pistons.

In embodiments where the system instead operates as a heat pump, the heat-addition process may occur at or near the cold temperature and the heat-rejection process may occur at or near the hot temperature. The pistons then still move such that the total volume generally increases when heat is added to the working fluid and generally decreases when heat is removed from the working fluid, but mechanical work must then be applied to the pistons.

In some instances, the passageway includes a regenerator, which acts as a heat-storage mechanism and heats the working fluid to a temperature close to the hot temperature as the working fluid exits the regenerator when the working fluid is flowing towards the hot working space. The regenerator may also cool the working fluid to a temperature close to the cold temperature as the working fluid exits the regenerator when the working fluid is flowing towards the cold working space.

The upper hot and cold regions of the system illustrated in FIG. 2 may be coupled through an upper-cylinder regenerator 232 with passageways 228 and 234 that allow for the transmittal of working fluid between the upper hot and cold regions. The lower hot and cold regions may likewise be coupled with a lower-cylinder regenerator 236. Mist eliminators 240 may be included in the passageways 228 and 234 to remove from the working fluid any aerosol of the liquid dispersible material entrained in the working fluid as the working fluid is conveyed between the cold and hot regions of the system.

Because any heat that flows through a thermally conductive path that is not part of the thermodynamic process represents a thermodynamic loss, the hot and cold cylinders may be provided as separate components separated by a distance and thermally isolated from each other, so as to reduce heat conduction between them, connected only by the passageway. The other paths for heat conduction may be limited to include only the interface between the cylinders and their mounting on the rest of the structure and the piston rods. Heat conduction through all of these paths may be mitigated by the selection of materials and design techniques applied outside of and away from the cylinders. Because the temperature of each cylinder may be uniform, heat conduction may be minimized or eliminated within each one. The materials of the cylinders and pistons can therefore be chosen without concern for thermal conduction.

In the cold region of the system, a cold-liquid reservoir 260 contains a cold liquid dispersible material 256 that may be injected with a pump 264 into the working fluid of the working space of the cold region of the system through injector 244. The system may also include more than one injector 244 coupled with each pump 264. A similar structure is provided in the hot region of the system, with a hot liquid dispersible material 220 being maintained in a hot-liquid reservoir 216 and having a similar pump structure to inject the hot liquid through injectors into the working fluid of the hot region. Within each of the reservoirs 260 and 216, there may be a steady-pressure region 212 and a variable-pressure region 208, separated by small orifices 252 that do not permit rapid flow of either the liquid or the working fluid between the steady-pressure and variable-pressure regions, with similar such structures being provided for the working spaces throughout the hot and cold regions of the system. The steady-pressure regions of the hot-liquid reservoirs 216 may be connected and the level of the hot liquid 220 maintained by a single make-up supply system. Similarly, the steady-pressure regions of the cold-liquid reservoirs 260 may be connected and the level of the cold liquid 256 maintained by a single make-up supply system.

The liquid dispersible material can form gas-tight seals across pistons or piston rods, eliminating spring-loaded or otherwise energized rings that contact and slide over surfaces. The clearance between such moving parts, when filled with liquid, can be an order of magnitude greater than the clearance needed in a dry clearance seal, thus enabling these parts to be manufactured to looser tolerances and thereby be more easily manufactured. Lubricated by the liquid, such a liquid-filled seal would have the low friction of a clearance seal as well as the low leakage of a contacting seal.

The liquid dispersible material can form a hydrodynamic film, and can thus be used as the lubricant for all other moving parts of the system. If there is no combustion process that can contaminate the liquid, the liquid need not contain special additives for preventing fouling by combustion products, as are needed in the lubricating oil of internal combustion engines, and the liquid need not be changed nearly as often, if at all. If the difference in temperature between the hot and cold regions is so great that a single liquid is not suitable for use in both regions, different liquids may be used, provided that they are relatively easily separated, such as by being immiscible.

The liquid dispersible material may be injected continuously or intermittently via a single port. Alternatively, the liquid may be injected through more than one port, either continuously or intermittently through each port. Further, the injection through such ports may occur in a staged manner, serially or overlapping each other in time and/or space.

Additional injectors may be deployed along the side of the cylinder so as to inject more or less liquid dispersible material as the piston motion progressively uncovers and covers the injector outlets. Provided that the heat addition or heat rejection process remains adequately close to isothermal, injectors so deployed would allow the liquid to be injected into the cylinder at an automatically varying rate approximately proportional to the length of the cylinder exposed by the piston, thus better matching the potentially variable rate at which the liquid can be evacuated from the cylinder. In addition, liquid pressure from the covered injector outlets may be high enough to support the piston on a hydrostatic bearing formed between the side of the piston and the cylinder, which may be advantageous if the velocity of the piston is not high enough to develop a lubricating hydrodynamic film. This is particularly the case in embodiments where the cylinders are substantially horizontal.

In certain embodiments where the hot temperature is low enough, a high-temperature heat transfer oil can be used as the liquid dispersible material. If air is undesirable as a working fluid because of the risk of accelerated oxidation or even combustion of the heat-transfer fluid, the working fluid could be other materials more compatible with the heat transfer oil, such as inert gases such as nitrogen, which in one embodiment is provided to all engines in an installation by a small membrane-separation process that inexpensively extracts nitrogen from air.

The rate at which the liquid dispersible material is injected into the cylinders may sometimes be substantial, the more so the higher the pressure of the working fluid or the lower the change in temperature of the liquid between injection and evacuation from the cylinder. The piston and the cylinder may thus allow rapid evacuation and return of the liquid to the reservoir from which it is conveyed. Rapid evacuation may be promoted by intercepting the injected liquid after it has traversed the working fluid in the working space with grooves, fins, screens, and/or the like on the cylinder or piston surfaces, to collect the liquid and direct it back to the variable-pressure region of its reservoir, and to absorb enough of its kinetic energy so as to prevent the liquid from splashing back into that portion of the working space traversed by the piston.

So that the power consumed by injecting the liquid dispersible material is minimized, pumping of the liquid against a large pressure difference may be avoided. The pressure to the inlet of the conveyance mechanism may thus be maintained near the pressure of the working fluid, resulting in each double-acting cylinder having two conveyance mechanisms—one dedicated to the working space on each face of the piston in that cylinder. Working spaces having processes at the same temperature, either hot or cold, in a multiple-cylinder engine or heat pump whose pressure versus time waveforms are in phase, however, may be supplied from the same conveyance mechanism.

There is an optimum flow rate that trades off the gain in thermal efficiency by approaching ideal isothermal heat addition and heat rejection against the pumping losses and losses caused by the liquid dispersible material interfering with the motion of the piston.

Liquid dispersible material may be separated out of the working fluid to keep the liquid from flooding the regenerator. To the extent that the vapor pressure of the liquid is significant, condensation of vapor in the regenerator preferably does not degrade the heat conduction behavior of the regenerator. In some instances, therefore, the condensed vapor may be made to drain back to the hot side of the regenerator so that the heat convected by the condensed vapor draining towards the hot end of the regenerator offsets the heat conducted through the material of the regenerator towards the cold end of the regenerator. Such a process may be facilitated by the configuration of horizontal cylinders arranged in two radial banks described above, where the cold ends of the regenerators may be elevated above their hot ends.

With appropriate efforts applied to minimizing the remaining losses, over 90% of the Carnot limit may be obtained in some embodiments, and over 85% of the Carnot limit may be obtained over a 5:1 ratio in mechanical power, achieved by variation in speed or in the average pressure of the working fluid.

Thus, having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method of operating a thermodynamic engine configured to convert between mechanical and thermodynamic energy by action of a working fluid on a mechanical component, the method comprising:

effecting cyclic motion of the working fluid between a hot region of the thermodynamic engine and a cold region of the thermodynamic engine, the hot region having a temperature greater than a temperature of the cold region; and injecting a dispersible material into the working fluid at a working space of at least one of the hot region and the cold region to effect a heat-exchange process between the dispersible material and the working fluid without effecting substantial work on the working fluid or on the mechanical component with the dispersible material;

collecting the dispersible material an at least one reservoir, wherein the at least one reservoir includes a steady-pressure region and a variable-pressure region separated by at least one orifice.

2. The method recited in claim 1 wherein injecting the dispersible material comprises:

injecting a hot dispersible material into the working fluid at a hot working space of the hot region of the thermodynamic engine; and injecting a cold dispersible material into the working fluid at a cold working space of the cold region of the thermodynamic engine.

3. The method recited in claim 2 wherein the cold dispersible material is different from the hot dispersible material.

4. The method recited in claim 1 wherein injecting the dispersible material comprises substantially continuously injecting the dispersible material into the working fluid.

5. The method recited in claim 4 further comprising substantially continuously evacuating the dispersible material from the working space.

6. The method recited in claim 5 further comprising directing the evacuated dispersible material to a heat exchanger, wherein injecting the dispersible material into the working fluid comprises injecting dispersible material emanating from the heat exchanger into the working fluid.

7. The method recited in claim 1 wherein the dispersible material comprises a liquid, a powder, or a slurry.

8. The method recited in claim 1 wherein the working fluid is compressible.

9. The method recited in claim 1 further comprising maintaining a temperature of the hot region and maintaining a temperature of the cold region.

10. The method recited in claim 1 wherein the thermodynamic engine is a heat pump.

11. The method recited in claim 1 wherein injecting the dispersible material comprises substantially intermittently injecting the dispersible material into the working fluid.

12. The method recited in claim 11 wherein substantially intermittently injecting the dispersible material into the working fluid is performed substantially correlated with an intermittent process of the working fluid.

13. The method recited in claim 1 wherein injecting the dispersible material into the working fluid comprises injecting the dispersible material in a pattern.

14. The method recited in claim 1 further comprising evacuating the dispersible material from the working space.

15. The method recited in claim 14 further comprising directing the evacuated dispersible material to a heat exchanger, wherein injecting the dispersible material into the working fluid comprises injecting the dispersible material emanating from the heat exchanger into the working fluid.

16. The method recited in claim 14 wherein evacuating the dispersible material from the working space comprises substantially intermittently evacuating the dispersible material from the working space.

17. The method recited in claim 1 wherein injecting the dispersible material is effected via multiple ports.

18. The method recited in claim 1 wherein the dispersible material comprises, a liquid dispersible material, the method further comprising forming a hydrodynamic bearing with the liquid dispersible material.

19. A method of operating a thermodynamic engine configured to convert between mechanical and thermodynamic energy by action of a working fluid on a mechanical component, the method comprising: effecting cyclic motion of the working fluid between a hot region of the thermodynamic engine and a cold region of the thermodynamic engine, the hot region having a temperature greater than a temperature of the cold region; injecting a dispersible material into the working fluid at a working space of at least one of the hot region and the cold region to effect a heat-exchange process between the dispersible material and the working fluid without effecting substantial work on the working fluid or on the mechanical component with the dispersible material, wherein the dispersible material comprises a liquid dispersible material, the method further comprising forming a hydrostatic bearing with the liquid dispersible material; and collecting the dispersible material in at least one reservoir, wherein the at least one reservoir includes a steady-pressure region and a variable-pressure region separated by at least one orifice.

20. The method recited in claim 1 wherein the dispersible material comprises a liquid dispersible material, the method further comprising forming a dynamic seal with the liquid dispersible material.

21. The method recited in claim 1 wherein the dispersible material comprises a liquid dispersible material, the method further comprising flowing the liquid dispersible material over a surface to convect heat in a direction different from a direction heat conducts in a material comprising the surface.

22. A thermodynamic engine comprising:

a mechanical component;

a hot region at a hot temperature;

a cold region at a cold temperature, wherein the hot temperature is greater than the cold temperature;

a working fluid;

a dispersible material;

a mechanism for effecting cyclic motion of the working fluid between the hot region and the cold region to convert between mechanical and thermodynamic energy by action of the working fluid on the mechanical component; and a mechanism for injecting the dispersible material into the working fluid in a working space of at least one of the hot region and the cold region to effect a heat-exchange process between the dispersible material and the working fluid without effecting substantial work on the working fluid or on the mechanical component with the dispersible material; and a mechanism for holding the dispersible material, wherein the mechanism includes a steady-pressure region and a variable-pressure region separated by at least one orifice.

23. The thermodynamic engine recited in claim 22 wherein the mechanism for injecting the dispersible material comprises:

a mechanism for injecting a hot dispersible material into the working fluid at a hot working space at the hot region of the thermodynamic engine; and a mechanism for injecting a cold dispersible material into the working fluid at a cold working space at the cold region of the thermodynamic engine.

24. The thermodynamic engine recited in claim 23 wherein the cold dispersible material is different from the hot dispersible material.

25. The thermodynamic engine recited in claim 22 wherein the mechanism for injecting the dispersible material is adapted to substantially continuously inject the dispersible material into the working fluid.

26. The thermodynamic engine recited in claim 22 wherein the mechanism for injecting the dispersible material is adapted to intermittently inject the dispersible material into the working fluid.

27. The thermodynamic engine recited in claim 22 wherein the mechanism for injecting the dispersible material is adapted to intermittently inject the dispersible material into the working fluid substantially correlated in time with an intermittent process of the working fluid.

28. The thermodynamic engine recited in claim 22 wherein the mechanism for injecting the dispersible material into the working fluid is adapted to inject the dispersible material into the working fluid in a pattern.

29. The thermodynamic engine recited in claim 22 wherein the mechanism for injecting the dispersible material into the working fluid comprises multiple ports.

30. The thermodynamic engine recited in claim 22 further comprising a mechanism for evacuating the dispersible material from the working space.

31. The thermodynamic engine recited in claim 30 further comprising a mechanism for evacuating the dispersible material from the working space, the mechanism for evacuating the dispersible material comprising a cylinder containing a moveable piston.

32. The thermodynamic engine recited in claim 31 wherein the cylinder comprises a horizontal cylinder.

33. The thermodynamic engine recited in claim 30 wherein the mechanism for evacuating the dispersible material is adapted to substantially continuously evacuate the dispersible material from the working space.

34. The thermodynamic engine recited in claim 30 wherein the mechanism for evacuating the dispersible material is adapted to intermittently evacuate the dispersible material from the working space.

35. The thermodynamic engine recited in claim 30 further comprising a heat exchanger positioned to receive the evacuated dispersible material and to provide the dispersible material to the mechanism for injecting the dispersible material into the working fluid.

36. The thermodynamic engine recited in claim 22 wherein the dispersible material comprises a liquid, powder, or slurry.

37. The thermodynamic engine recited in claim 22 wherein the working fluid is compressible.

38. The thermodynamic engine recited in claim 22 wherein the hot region is maintained at the hot temperature and the cold region is maintained at the cold temperature.

39. A heat pump comprising:

a hot region at a hot temperature;

a cold region at a cold temperature, wherein the hot temperature is greater than the cold temperature;

a working fluid;

a dispersible material;

a mechanism for effecting cyclic motion of the working fluid between the hot region and the cold region; and a mechanism for injecting the dispersible material into the working fluid in a working space of at least one of the hot region and the cold region to effect a heat-exchange process between the dispersible material and the working fluid; and a mechanism for holding the dispersible material, wherein the mechanism includes a steady-pressure region and a variable-pressure region separated by at least one orifice.

* * * * *